US005715977A

United States Patent [19]

Goncalves

[11] Patent Number: 5,715,977

[45] Date of Patent: Feb. 10, 1998

[54] CONTAINER TOP INCLUDING A RING PROVIDED WITH A DISTRIBUTION CAPSULE HAVING A PARTIALLY UNSCREWABLE CAP

[75] Inventor: Agnes Goncalves, Soisy Sous Montmorency, France

[73] Assignee: Axia Cap, Goussainville, France

[21] Appl. No.: 585,162

[22] Filed: Jan. 11, 1996

[30] Foreign Application Priority Data

Jan. 10, 1995 [FR] France ..... 95 00183

[51] Int. Cl.[6] ..... B67D 3/00

[52] U.S. Cl. ..... 222/521; 222/153.14; 222/520; 222/549; 222/1

[58] Field of Search ..... 222/153.06, 153.14, 222/519, 520, 494, 549, 545, 562, 1, 521

[56] References Cited

U.S. PATENT DOCUMENTS 4,561,570 12/1985 Zulauf .
4,967,941 11/1990 Beck .
5,038,967 8/1991 Braun .

FOREIGN PATENT DOCUMENTS 875827 10/1979 Belgium .
0111798 6/1984 European Pat. Off. .
1545591 11/1968 France .
2531408 2/1984 France .
2346074 3/1975 Germany .
8715396 3/1988 Germany .
9204076 7/1993 Germany .
9418851 2/1995 Germany .
4328582 3/1995 Germany .
2124603 2/1984 United Kingdom .

*Primary Examiner*—Gregory L. Huson
*Attorney, Agent, or Firm*—Greenblum & Bernstein, P.L.C.

[57] ABSTRACT

A receiver, i.e., a container, has a ring provided with a distribution capsule. The capsule includes a cap provided with at least one distribution orifice which is mounted to be screwed and unscrewed between at least two positions, by at least one thread provided on the ring. The capsule also includes a reducer which is integral or attached to the ring and provided with a blocking tip so as to block at will the orifice of the cap as a function of its position on the ring. The ring of the container includes two parallel screwing threads adapted to cooperate each with a spur provided in the cap. The ring also includes helical ramps for assembly of the cap on the ring. The winding direction of the helical ramps alternates every quarter turn such that the helical ramps form two points and two recesses. Each recess is extended by a longitudinal groove which extends at least toward one of the threads and which is capable of receiving one of the spurs of the cap during assembly of the cap on the ring.

20 Claims, 4 Drawing Sheets

Fig - 1
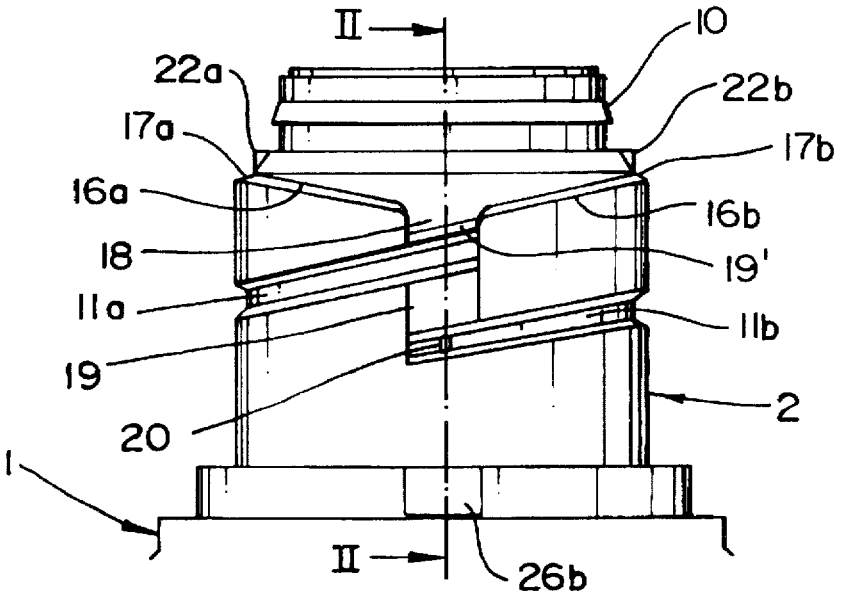
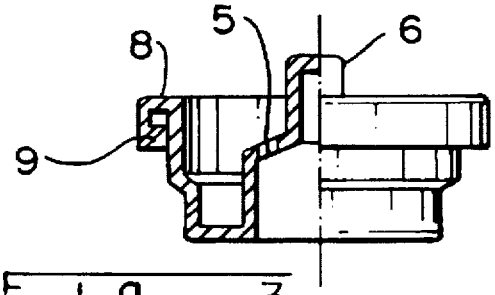
Fig - 3
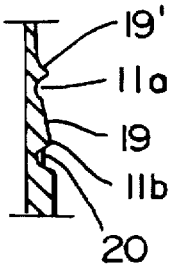
Fig - 2
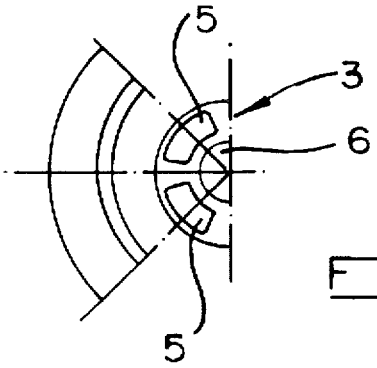
Fig - 4

CONTAINER TOP INCLUDING A RING PROVIDED WITH A DISTRIBUTION CAPSULE HAVING A PARTIALLY UNSCREWABLE CAP

BACKGROUND OF THE INVENTION

1. Field of the Invention

The present invention relates to a ring receiver provided with a distribution capsule having a partially unscrewable cap, the receiver, i.e. container, containing a product to be distributed and more particularly a liquid or paste product.

2. Description of Background and Material Information

The distribution capsules preferably replace simple caps to be unscrewed. The distribution capsules remain attached to the container, while the opening and closing occurs by a particular manipulation of the capsule.

The capsule comprises, on the one hand, a cap provided with at least one distribution orifice which is mounted to screw and unscrew between at least two positions, by means of at least one thread provided on the ring, and on the other hand, a reducer which is integral with or attached to the ring and provided with a blocking tip, in a manner so as to block at will the orifice of the cap as a function of its position on the ring.

Generally, the cap orifice is central, as disclosed, for example, in French Patent Publication No. 1,545,591. Also known are systems of this type having a plurality of outputs or a variable output, the output being defined by the position of the cap with respect to the ring and thus to the blocker.

In all cases, the cap must be mounted on the ring such that it can assume at least two positions without separating from the receiver.

To this end, the spurs or the like, with which the cap is provided, must engage the threads to prevent the spurs from accidentally escaping from the threads.

Depending upon the embodiment, the present invention may involve filling the receiver provided with its ring before positioning the capsule thereon, or filling the receiver from the bottom, the receiver being already equipped or not with its capsule, or welding a ring on a receiver, the ring being provided with its capsule. In all embodiments, it is still necessary to mount the capsule on the ring. This assembly operation will be able, depending on the case, to be achieved by the manufacturer or by the company which is filling the receiver with product.

Until now, delicate reference and positioning systems were necessary to ensure that the cap would be presented at a good angular position with respect to the ring.

SUMMARY OF THE INVENTION

The present invention has been proposed to overcome the aforementioned problems with prior systems and, more particularly, the present invention proposes a receiver of the above type, whose design is particularly simplified.

To this end, the receiver according to the invention is notable in that the ring of the receiver comprises two parallel screw threads, which are limited and adapted to cooperate each with a spur provided in the cap. The ring further comprises helical ramps for assembling the cap whose winding directions are alternating each quarter turn such that the ramps form between them two points and respectively two recesses which are diametrically opposed. Each recess is extended by a longitudinal groove which extends towards at least one of the threads and is adapted to receive one of the spurs of the cap in the course of assembly thereof on the ring.

Preferably, each longitudinal groove opens into the corresponding thread by means of a rib which is passed by force by the corresponding spur of the cap. The rib has an anti-return abutment, and preferably, the longitudinal grooves open at least at the starting ends of the threads, such that during assembly, the cap assumes a blocking position.

According to a very interesting embodiment, each of the threads extends symmetrically over somewhat more than half a turn such that each thread begins in a longitudinal groove and ends in the other longitudinal groove. The starting end of the thread is separated from the final end of the other thread by a rib serving as an anti-return abutment. The corresponding spur of the cap is forced over the rib, at the moment of the assembly, but also if one wishes to obtain a closure by exerting a pressure on the cap.

Thus, the cap can be closed by screwing down or by simple pressure exerted on the cap.

Furthermore, a half turn rotation makes it possible to re-achieve a symmetrical position, which is preferable for example, for a cap and a receiver of non-circular section.

Preferably, the rib which separates the threads has an increasing thickness towards the base of the ring so as to facilitate in this direction the forced passage and to improve the anti-return retention. Also the final end of each thread is closed with respect to the corresponding longitudinal groove, by a rib which is passed by force by the corresponding spur of the cap in the course of assembly such that the rib serves as an anti-return abutment.

According to one embodiment, each spur is a small rib of a width at most equal to that of the longitudinal groove in which it is engaged during the assembly. Preferably, each rib forms a spur which has a shape corresponding substantially to that of the threads.

The rib forming the spur may have, in its median portion, a cutout adapted to cooperate with a small projection provided in the corresponding thread facing the longitudinal groove so as to assure a marking and/or latching of the position.

One particular embodiment is notable in that the cap comprises at least one longitudinal rib on its internal wall, adapted to cooperate with at least one projection provided on the helical assembly ramps so as to assure a latching and/or a sound marking upon closure and opening. Preferably, the cap comprises only a single longitudinal rib slightly offset towards one of the spurs with respect to a plane perpendicular to the plane passing through the spurs, while the assembly ramps are provided with two projections arranged at the level of the points formed by the ramps.

According to certain embodiments, the cap has a tubular coaxial element at its opening, adapted to slide in a sealed manner on or in a shaft provided on the reducer.

To assure a protection even when the cap is in the open position, the orifice of the cap is equipped with a joint provided with a slit and a housing for the blocking tip such that the blocking tip, in the blocking position, blocks in a sealed manner the slit of the Joint by coming to be positioned in its housing. In the open position, the joint serves as a valve by allowing for the evacuation product through its slit, while preventing the possible introduction of impurities from the opposite direction.

According to another embodiment, the receiver can be equipped with a tamper-proof system comprising a strip affixed in a detachable manner to the base of the cap. The strip is provided with blocking means adapted to cooperate with conjugated means provided on the receiver ring as soon as the cap is assembled on the ring such that the cap cannot turn relative to the ring as long as the strip is not withdrawn. For example, in this case, the means for blocking the strip on the cap constitute also the means for fixing the strip on the cap. The blocking means may comprise at least two tongues connected to the cap in a detachable manner, whereas the conjugated means of the ring may comprise at least two cutouts provided in a base of the ring, in the same angular position as the tongues in the closure position, so as to receive the tongue during the assembly of the cap on the ring. The tongues are positioned in a diametrically opposed manner, in the same axial plane as that of the spurs, while the cutouts are provided also in a diametrically opposed manner, in the same axial plane as the longitudinal grooves.

One of the advantages of the structure of the cap and of the ring of the present invention involves ease of assembly.

Thus, the present invention also relates to a process for assembling the cap on the ring of a receiver. The process for assembly comprises, regardless of the initial position of the cap with respect to the ring, rotationally driving the cap with respect to the ring while an axial pressure is exerted thereon until the spurs of the cap reach the starting ends of the threads after having been guided on the helical ramps and then in the longitudinal grooves.

BRIEF DESCRIPTION OF THE DRAWINGS

The invention will be better understood and other details will become clear from a reading of the description which follows and which refers to the annexed drawings in which:

FIG. 1 shows, in elevation, the ring of a receiver according to the invention;

FIG. 2 is a partial cross section along line II—II of FIG. 1;

FIG. 3 shows in half cross section and half elevation a reducer for the receiver according to the invention;

FIG. 4 is a partial top view of the reducer of FIG. 3;

DETAILED DESCRIPTION OF THE PREFERRED EMBODIMENTS

The drawings show a receiver 1 provided with a ring 2 (FIGS. 1, 7, 8 and 10).

Figure 10:
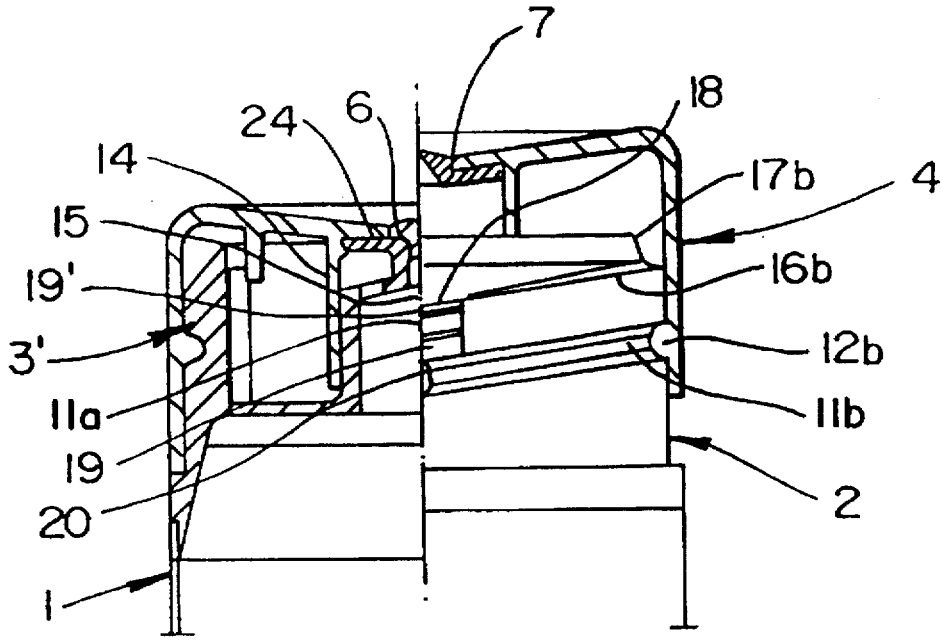
FIG. 10 corresponds to FIG. 7 according to another embodiment whose cap orifice is provided with a joint.

The embodiments of FIGS. 1–9 on the one hand, and FIG. 10 on the other, being very similar, the same reference numerals are used for similar elements.

A reducer 3 (FIGS. 3, 4 and 7) or 3' (FIG. 10) is fixed on ring 2.

Figure 7:
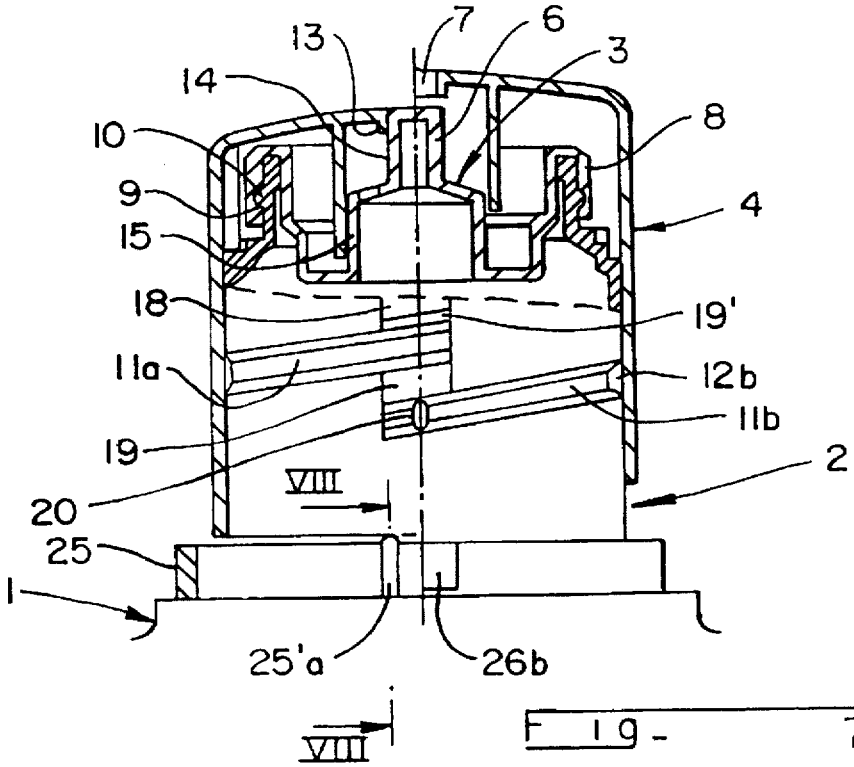
FIG. 7 shows two axial half cross sections of the ring of the receiver equipped with its reducer and a cap, respectively on the left side in the closed position and on the right side in the open position.
Figure 8:
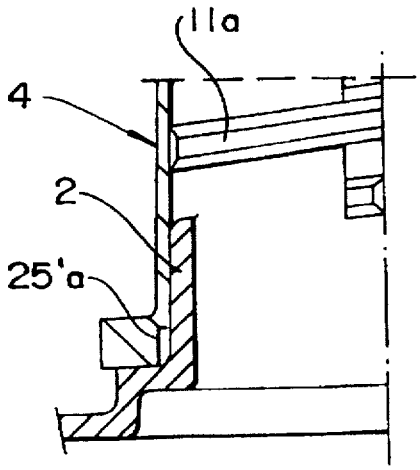
FIG. 8 is a half cross section along line VIII—VIII of FIG. 7.
Figure 9:
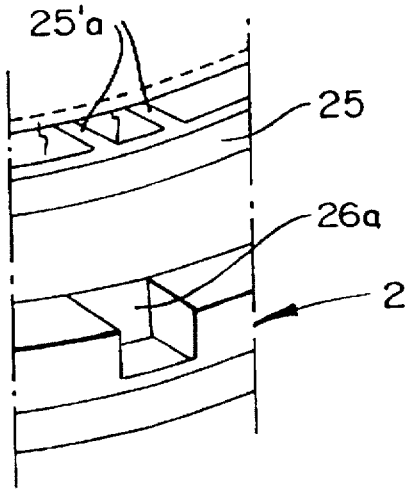
FIG. 9 is a partial View in perspective of a part of the cap and of the ring at the level of its cutout.

The reducer 3 of FIGS. 3, 4 and 7 is affixed by clipping on ring 2, as it is explained below, while the reducer 3' of FIG. 10 is of a single piece with the ring 2.

Reducer 3, 3' forms with a cap 4 (FIGS. 5, 6, 7, 8 and 10), a distribution capsule.

Reducer 3, 3' comprises passage openings such as 5 (FIGS. 3 and 4) for the product contained in the receiver 1 and a blocking tip 6.

The blocking tip 6 is adapted to block at will a central orifice 7 provided in the cap 4.

In the embodiment of FIGS. 1–9, whose receiver 1 is shown for example in the form of a flask, reducer 3 is affixed on ring 2 by means of a groove 8 (FIGS. 3 and 7) which covers an edge of ring 2 to hook thereon by cooperation of an interior rib 9 which cooperates (FIGS. 3 and 7) with an exterior rib 10 (FIGS. 1 and 7) arranged on ring 2.

In this embodiment, one can for example fill the flask and then position the reducer, then the cap, as will be described below.

Figure 11:
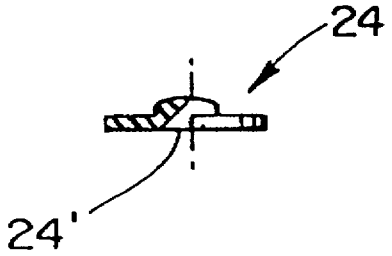
FIGS. 11 and 12 respectively show in half cross section and top view, the joint of the embodiment of FIG. 10.
Figure 12:
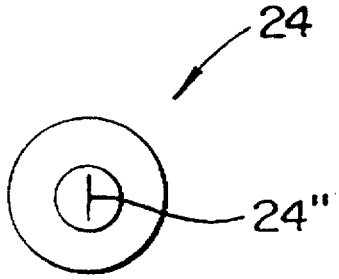

On the other hand, in the embodiment of FIGS. 10–12, reducer 3' is integral with, or of attached to, ring 2. It can be used, for example, to equip a tube whose filling occurs from the bottom.

Ring 2, reducer 3, 3' and the cap 4 can also be premounted, the ring then being affixed on a receiver.

To ensure the blocking, i.e., closing, or the opening of the orifice 7 of the cap 4, the cap 4 is screwably mounted on ring 2 by cooperation of two threads 11*a*, 11*b* (FIGS. 1, 7, 8 and 10) arranged parallel on the ring 2 over slightly more than a half-turn each and two spurs 12*a*, 12*b* provided in a diametrically opposed manner on the internal wall of the cap 4 (FIGS. 5–7 and 10).

In the embodiment shown, the threads 11*a*, 11*b* are symmetrically positioned such that the start of one of the threads is vertically aligned with the end of the other thread, as shown in the drawings.

The spurs 12*a* and 12*b* are shown in the form of oblique ribs whose slopes corresponds to that of threads 11*a* and 11*b* with which they are adapted to cooperate.

Thus, after mounting of the cap 4 on the ring 2, the cap can assume a blocking position in which the tip 6 at reducer 3, 3' blocks the orifice 7 of the cap, as shown in the left portions of FIGS. 7 and 10, and an open position as shown in the right portions of the figures, although the orifice 7 of the embodiment of FIG. 10 is provided, as will be explained below, with a joint.

The blocking and open positions correspond to the extreme positions of the spurs 12*a* and 12*b* which are respectively located at the beginning and at the end of the corresponding threads 11*a* and 11*b*.

It is well understood that it suffices to unscrew or to screw down the cap to open or close the cap. However, to close the cap, one can also exert simple pressure on the cap which is unusual for screw down caps. This function will be explained below.

As shown further in the drawings, to ensure a good seal upon closure, the central orifice 7 of the cap 4 comprises, in the embodiment of FIGS. 1–9, a small angular skirt 13 (FIGS. 5–7) which extends towards the interior and whose internal diameter corresponds to the external diameter of the tip 6.

It is to be understood that skirt 13 ensures sealing upon closure. However, one can also desire protection of the apparatus in the open position, particularly for a tube of tan lotion (sun cream for example). It is for this reason that the embodiment of FIGS. 10–12 comprises a joint 24 fixed in the orifice 7 of the cap 4 and provided with a housing 24' (FIG. 11) and with a central slit 24" (FIG. 12). In the blocking position, the tip 6 is positioned in the housing 24' and blocks the slit 24" in a sealed manner.

The joint 24 can also serve as a valve in the open position (right portion of FIG. 10) while allowing for the product to pass through the slit 24" by pressure while the joint 24 prevents the possible entry of impurities.

Likewise, a tubular element 14 extends coaxially to the orifice 7 and/or to the skirt 13 to slide in a sealed manner on a shaft 15 (FIGS. 7 and 10) or according to an alternative, in a shaft provided on reducer 3'.

To assemble of the cap 4 on the ring 2, the invention provides completely original means.

In effect, FIGS. 1 and 10 illustrate that the ring 2 of the receiver comprises helical access and assembly ramps such as 16*a* and 16*b*.

The helical ramps, of which two, 16*a* and 16*b* only are visible on the drawings, are in fact four in number, while their winding direction is alternating from one to the other each quarter turn.

Thus, there are two pairs of ramps, the ramps of each pair being similar amongst them and diametrically opposed, whereas the ramps of one pair have a winding direction opposing that of the ramps of the other pair.

In this way, the ramps form two points 17*a* and 17*b* (FIGS. 1 and 10) and two diametrically opposed recesses, of which only one is visible in the figures (the other being thus diametrically opposed).

Each recess is extended by a longitudinal groove such as the groove 18 seen in the drawings. In each longitudinal groove 18, the final end of a thread (11*a*, 11*b*) and the starting end of the other threading (respectively 11*b* and 11*a*) are vertically aligned with one another.

As further shown in the drawings, the final end of a thread (11*a*, 11*b*) and the starting end of the other thread (11*b*, 11*a*) are separated between them in the longitudinal grooves 18 by a rib 19, while the final ends are separated from the longitudinal grooves 18 by another rib 19' (FIGS. 1, 2, 7, 10).

As seen in FIG. 2, the rib 19 has an increasing thickness as it approaches the base of the ring 2.

At the beginning of each threading, a small projection 20 is provided under the rib 19.

Furthermore, the spurs 12*a* and 12*b* of the cap 4, which are presented in the form of ribs, are each provided with a median cutout 21*a* and 21*b* adapted to cooperate with the projections 20 noted above and as will be explained below. Furthermore, the spurs have a width similar to that of the longitudinal grooves 18.

Figure 5:
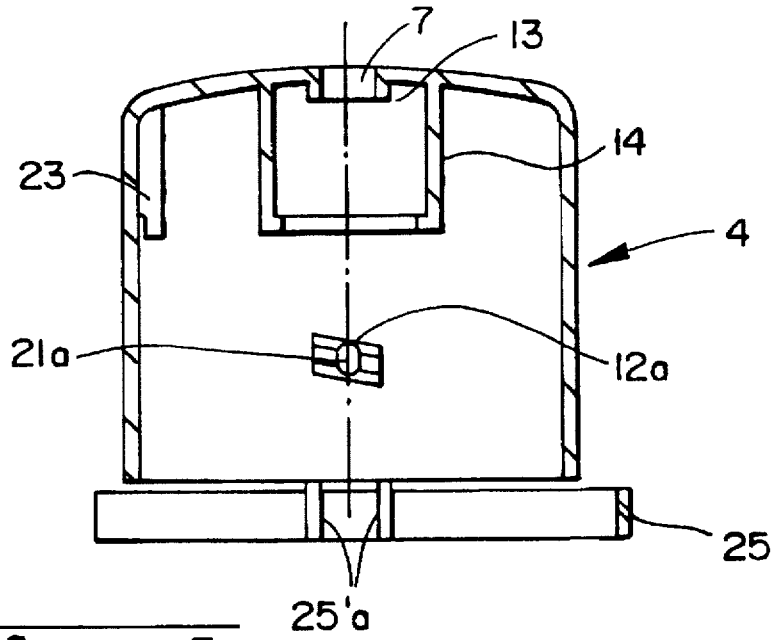
FIG. 5 is an axial cross section view of a cap according to the invention.
Figure 6:
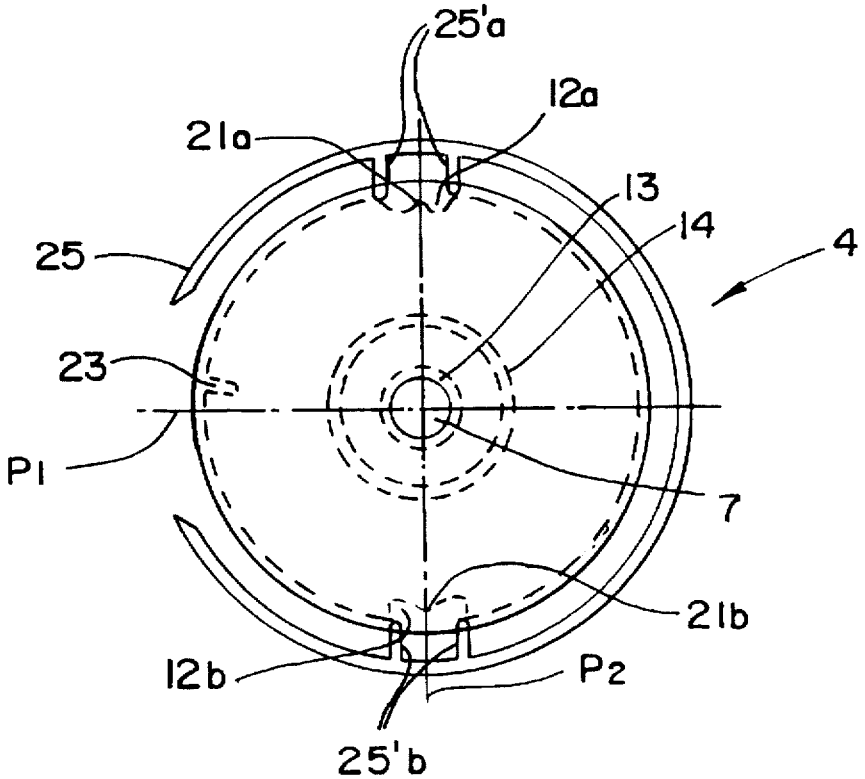
FIG. 6 is a top view of the embodiment of FIG. 5.

As further seen in FIG. 1, the points 17*a* and 17*b* formed by the ramps 16*a* and 16*b* are provided with two thin projections 22*a* and 22*b* (FIG. 1), adapted to cooperate with a longitudinal rib 23 provided on the internal wall of the cap 4 (FIGS. 5 and 6) and which is made slightly closer to one of the spurs (here spur 12*a*) than to the other, with respect to the plane P1 perpendicular to the plane P2 passing through the spurs (FIG. 6).

To ensure a tamper-proof arrangement (and only if it is desired), i.e., a prevention of use without it being visible, the cap 4 can be provided at its base with a detachable strip 25 (FIGS. 5–9), making almost a complete turn (as shown in FIG. 6).

This strip 25 projects downwardly and is affixed here to the cap 4 by two pairs of tongues 25'*a*, 25'*b*, forming a 0 and connected to the cap 4, as seen in the drawings, by self breaking flaps.

The pairs of tongues 25'*a* and 25'*b* are diametrically opposed and positioned here in the same axial plane P2 (FIG. 6) as the spurs 12*a* and 12*b*.

Ring 2 comprises in its base (FIGS. 1, 7 and 9), two cutouts 26*a* and 26*b* which are diametrically opposed and positioned in the same axial plane as the grooves 18.

Given the positioning of the tongues 25'*a* and 25'*b* and cutouts 26*a* and 26*b*, the tongues can be housed in the cutouts during assembly of the cap, as will be explained below. The angular positioning of the tongues and of the cutouts could also be different from that indicated above, on the condition that the tongues and the cutouts be aligned at the moment of assembly, i.e., in angular position of closure.

The process of assembly of cap 4 on ring 2 is described as follows.

Indeed, it suffices, in an assembly line and/or packing line to rotate cap 4 in any direction and regardless of its initial angular position, to exert a certain pressure on the cap.

If necessary, a simple pressure can suffice, the shape of the ramps alone assuring rotation.

Thus, the spurs 12*a* and 12*b* of the cap slide on the helical ramps 16*a* and 16*b* to come to the end of their extent in the longitudinal grooves 18.

The spurs 12*a* and 12*b* then pass by force the ribs 19' and 19 which will serve as an anti-return abutment to thus end at the beginning of the threads 11*a* and 11*b*.

Thus the cap positions itself in the closed position.

Furthermore, the cutouts 21*a* and 21*b* of the spurs 12*a* and 12*b* overlap the small projections 20, thus assuring a latching of position upon closure at the end of the assembly.

Finally, it is to be understood also that in the course of this assembly, the pairs of tongues 25'*a* and 25'*b* of the strip come in the respective cutouts 26*a* and 26*b* of the ring (see in particular, FIGS. 8 and 9) thus blocking the cap in the closed position. This tamper-proof ability being obtained by virtue of the original design of the means utilized and the particular assembly of the cap on the ring.

Once the capsule is assembled, the use is simple. Indeed, after having removed strip 25 by seizing strip by its open portion, one can activate the cap 4 by rotation. It suffices to unscrew or to screw the cap 4 to open or close the capsule. The unscrewing or screwing motion displaces the blocking tip 6 which spaces itself from the skirt 13, or from the joint 24, and thus from the orifice 7 of the cap, or respectively introduces itself in the skirt or in the housing 24' of the aid joint.

Upon closing, the longitudinal rib 23 of the cap passes under force one of the projections 22*a* and 22*b* of the ring (along its initial position after assembly), which assures a latching and/or a sound marking upon opening and closure.

If threads (11*a* and 11*b*) were provided over slightly less than a half turn, since the ribs 19 and 19' are merged and the final and starting ends of each thread would not be vertically aligned with the respective starting and final ends of the other thread, the embodiments shown whose screwing and unscrewing occurs over a half turn, has very important advantages.

Besides the diametrically opposed repositioning of the cap between the open and closed positions, which can be interesting for non-circular exterior shapes, in the open position, a pressure on the cap assures the forced passage of the ribs 19 and 19' during assembly, and thus rapid closure of the capsule (same result as a screw down).

The shape of the ribs and, in particular, the shape of the rib 19 (see FIG. 2) is selected to constitute an anti-return abutment while facilitating the movement in the other direction.

It is clear however, that the invention relates to other embodiments in which the orifice 7 of the cap can be other than central and/or alone and it can likewise be a capsule having a plurality of outputs or a variable output.

What is claimed is:

1. A receiver comprising:

a ring having a distribution capsule, said distribution capsule comprising:

a cap provided with at least one distribution orifice, said cap being mounted to be screwed and unscrewed between at least two positions along two parallel screwing threads provided on said ring;

a reducer being one of integral and attached with said ting and being provided with a blocking tip capable of blocking at will said orifice of said cap as a function of position of said cap on said ring;

wherein each screwing thread is capable of cooperating with a corresponding spur provided in said cap;

wherein said ring comprises helical ramps for assembly of said cap, the helical ramps having winding directions alternating each quarter turn such that said helical ramps form two points and two diametrically opposed recesses, each recess being extended by a longitudinal groove which extends toward at least one of said screwing threads, each longitudinal groove being capable of receiving one of said spurs of said cap when said cap is assembled on said ring; and wherein each said longitudinal groove opens into at least one of said screwing threads via a rib, and wherein each spur of said cap is capable of passing each rib by force during assembly of said cap on said ring, said ribs being capable of serving as anti-return abutments.

2. A receiver according to claim 1, wherein:

said longitudinal grooves open at least into starting ends of said threads such that upon assembly, said cap assumes a blocking position.

3. A receiver according to claim 1, wherein:

said reducer comprises a shaft, said cap having a tubular element which is coaxial with one of said at least one orifice, the tubular element being capable of sliding in a sealed manner on or in the shaft of the reducer.

4. A receiver according to claim 1, wherein:

said at least one orifice of the cap is equipped with a joint provided with a slit and a housing for the blocking tip such that the blocking tip, in a blocking position, blocks in a sealed manner the slit of said joint, and in an open position, the joint serves as a valve to allow evacuation of product through the slit, while inhibiting entry of impurities into the receiver.

5. A receiver according to claim 1, wherein:

at least one helical ramp is provided with a projection, said cap comprising at least one longitudinal rib on an internal wall of said cap, said longitudinal rib being capable of cooperating with the projection of the helical ramps to provide at least one of latching and sound marking upon closing and opening.

6. A receiver according to claim 5, wherein:

said cap comprises a single longitudinal rib which is slightly offset toward one of the spurs with respect to a plane P1 perpendicular to a plane P2 passing through said spurs, said helical ramps being provided with two projections.

7. A receiver according to claim 1, wherein:

said screwing threads each extend symmetrically over slightly more than a half-turn such that each said screwing thread begins in one of said longitudinal grooves and ends in the other longitudinal groove, a starting end of said screwing thread being separated from a final end of the other screwing thread by one of said anti-return fibs, the anti-return ribs being shaped such that closure may be obtained by exerting a pressure on said cap.

8. A receiver according to claim 7, wherein:

said anti-return ribs separate said threads and have an increasing thickness toward a base of said ring to facilitate passage by force of said spurs and to improve retention of said spurs in said threads.

9. A receiver according to claim 7, wherein:

final ends of each of said threads are formed with respect to the longitudinal grooves, by said anti-return ribs.

10. A receiver according to claim 1, wherein:

each said spur comprises a small rib of a width at most equal to that of the longitudinal groove in which said spur engages during assembly.

11. A receiver according to claim 10, wherein:

said spur rib has a slope corresponding substantially to said screwing threads.

12. A receiver according to claim 10, wherein:

each screwing thread is provided with a small projection facing the longitudinal groove, each spur rib having in a median portion a cutout capable of cooperating with the small projection provided in the corresponding screwing thread to provide at least one of marking and latching of position.

13. A receiver according to claim 1, wherein:

said receiver is equipped with a tamper-proof system comprising a locking element provided on the ring of the receiver and a strip affixed in a detachable manner to a base of the cap, said strip comprising a blockage element capable of cooperating with the locking element of the ring such that when the cap is assembled on said ring, said cap can not turn relative to the ring as long as the strip is not removed.

14. A receiver according to claim 13, wherein:

said blockage element comprises a fixing element capable of fixing the strip on the cap, said fixing element comprising at least two tongues connected to the cap in a detachable manner, said locking element of the ring comprising at least two cutouts provided in a base of the ring, in a same angular position as the tongues in a position of closure, such that said at least two cutouts are capable of receiving said at least two tongues during assembly of the cap on the ring.

15. A receiver according to claim 14, wherein:

said at least two tongues are positioned in a diametrically opposed manner in a same axial plane P2 as that of the spurs, said cutouts being provided in a diametrically opposed manner in an axial plane with the longitudinal grooves.

16. A process for assembling a receiver, the receiver comprising:

a ring having a distribution capsule, said distribution capsule comprising:

a cap provided with at least one distribution orifice, said cap being mounted to be screwed and unscrewed between at least two positions along two parallel screwing threads provided on said ring;

a reducer being one of integral and attached with said ring and being provided with a blocking tip capable of blocking at will said orifice of said cap as a function of position of said cap on said ring;

wherein each screwing thread is capable of cooperating with a corresponding spur provided in said cap;

wherein said ring comprises helical ramps for assembly of said cap, the helical ramps having winding directions alternating each quarter turn such that said helical ramps form two points and two diametrically opposed recesses, each recess being extended by a longitudinal groove which extends toward at least one of said screwing threads, each longitudinal groove being capable of receiving one of said spurs of said cap when said cap is assembled on said ring;

wherein each said longitudinal groove opens into at least one of said screwing threads via a rib, and wherein each spur of said cap is capable of passing each rib by force during assembly of said cap on said ring, said ribs being capable of serving as anti-return abutments; and wherein the method comprises:

regardless of an initial position of the cap with respect to the ring, rotating the cap with respect to the ring while exerting thereon an axial pressure until the spurs of the cap reach starting ends of the threads after having been guided on the helical ramps and then in the longitudinal grooves.

17. A container top comprising:

a ring having two parallel screwing threads, said ring further comprising helical ramps having winding directions alternating each quarter turn such that said helical ramps form two points and two diametrically opposed recesses, each recess being extended by a longitudinal groove which extends toward at least one of said screwing threads, each said longitudinal groove opening into at least one of said screwing threads via an anti-return rib;

a distribution capsule adapted to cooperate with said ring, said distribution capsule comprising:

a cap provided with at least one distribution orifice, said cap having two spurs capable of cooperating with said two parallel screwing threads of the ring such that the cap is mounted to be screwed and unscrewed between at least two positions along said two parallel screwing threads of said ring;

a reducer being one of integral and attached with said ring and being provided with a blocking tip capable of blocking at will said orifice of said cap as a function of position of said cap on said ring; and wherein each longitudinal groove of said ring is capable of receiving one of said spurs of said cap when said cap is assembled on said ring, and wherein each spur of said cap is capable of passing each anti-return rib of said ring by force during assembly of said cap on said ring.

18. A receiver according to claim 17, wherein:

said longitudinal grooves open at least into starting ends of said threads such that upon assembly, said cap assumes a blocking position.

19. A receiver according to claim 17, wherein:

said screwing threads each extend symmetrically over slightly more than a half-turn such that each said screwing thread begins in one of said longitudinal grooves and ends in the other longitudinal groove, a starting end of said screwing threads being separated from a final end of the other screwing thread by one of said anti-return ribs, the anti-return ribs being shaped such that closure may be obtained by exerting a pressure on said cap.

20. A receiver according to claim 17, wherein:

said receiver is equipped with a tamper-proof system comprising a locking element provided on the ring of the receiver and a strip affixed in a detachable manner to a base of the cap, said strip comprising a blockage element capable of cooperating with the locking element of the ring such that when the cap is assembled on said ring, said cap can not turn relative to the ring as long as the strip is not removed.

* * * * *